United States Patent [19]

Jarrett et al.

[11] 3,973,484

[45] Aug. 10, 1976

[54] HAY PRESSER APPARATUS

[76] Inventors: Ronald T. Jarrett, 1625 Knight St.; Edward J. Barrett, 521 S. Tamarack, both of Helena, Mont. 59601

[22] Filed: Oct. 29, 1974

[21] Appl. No.: 518,255

[52] U.S. Cl. ..... 100/153; 100/35; 100/118; 100/DIG. 6; 100/DIG. 8; 425/DIG. 230; 425/237; 425/367

[51] Int. Cl.[2] ..... B30B 5/06; B30B 11/00

[58] Field of Search ..... 100/118–120, 100/151–154, DIG. 6, DIG. 7, DIG. 8, 35, 39; 425/DIG. 230, 294, 237, 363, 367

[56] References Cited

UNITED STATES PATENTS

| | | | |
|---|---|---|---|
| 50,158 | 9/1865 | Pool et al. | 100/121 UX |
| 313,322 | 3/1885 | Gorgas et al. | 100/152 X |
| 708,574 | 9/1902 | Milne | 425/363 |
| 1,055,384 | 3/1913 | Brune et al. | 100/120 |
| 1,542,348 | 6/1925 | Ostrom | 425/367 |
| 2,096,097 | 10/1937 | Fowle | 100/153 |
| 2,646,913 | 7/1953 | Goldberg et al. | 100/151 |
| 2,874,604 | 2/1959 | Diels et al. | 425/237 X |
| 3,023,559 | 3/1962 | Richey et al. | 100/155 R X |
| 3,365,749 | 1/1968 | Pinkham | 425/363 X |

FOREIGN PATENTS OR APPLICATIONS

| | | | |
|---|---|---|---|
| 508,855 | 2/1952 | Belgium | 100/118 |
| 1,165,986 | 3/1964 | Germany | 100/118 |
| 110,152 | 3/1944 | Sweden | 100/153 |
| 713,106 | 8/1954 | United Kingdom | 425/237 |
| 229,870 | 2/1969 | U.S.S.R. | 100/DIG. 6 |

*Primary Examiner*—Peter Feldman

[57] ABSTRACT

Hay and similar crop materials can be efficiently compacted and formed into pellets or cubes through a closely coordinated sequence of operations in which the hay picked up from the field is deposited into a feed bin, then advanced by gravity feed uniformly onto a cross feed conveyor which advances the hay through a compaction stage in which the hay is precompressed to bale density, and thereafter it is continuously advanced between a pair of counter-rotating press wheels which further compress and form the hay into dense pellets or cubes.

17 Claims, 12 Drawing Figures

HAY PRESSER APPARATUS

This invention relates to a novel and improved apparatus adaptable for compressing and dividing materials into compact form; and more particularly relates to a means for pressing crop materials such as hay into extremely dense cubes or pellets in a reliable and efficient manner.

BACKGROUND AND FIELD OF INVENTION

Various equipment has been devised in the past for compression of crop materials, such as, hay into small wafers or cubes with the desirable end of reducing waste, permitting storage or shipment of the hay in a compact condition and making it easier to handle, for example, in the feeding of animals. Typically, after the hay is picked up in the field it is transferred to a pelleting machine where the hay is compressed and separated into individual wafers or pellets and thereafter collected in a separate receptacle. Broadly, it is well-known to apply compressive forces to the hay by passing it through a pelleting zone formed by co-planar, counter-rotating press wheels between which the hay is compressed and divided into a highly dense package. Representative of such apparatus are those disclosed in the U.S. Pat. Nos. 1,094,320, 2,052,449, 3,023,559 and 3,430,583. However, equipment using such apparatus is not commercially available and has presented some difficulties and limitations in that it will not tolerate a very wide variation in feeding rates of the hay and does not establish the speed and precompression of the hay necessary for high rate production from a given size or capacity of machine. For instance, precompression of the hay into a dense stream permits the use of smaller press wheels and the regulation of the crosssectional size of the stream for most efficient feeding through the press wheels in final compression and cubing or pelleting of the hay. Otherwise, if the stream of hay leading into the press wheels is too large in relation to the diameter of the press wheels, the angle of the pressure between the hay and the press wheels is such as to oppose the motion of the hay. Moreover, increased speeds of the stream of hay at a controlled size permits use of smaller press wheels and associated drive trains. For these and other reasons, it is important that the condition size and density of the hay be closely controlled from its point of introduction into the machine through the final compression stage for most efficient, high speed production rates.

SUMMARY OF THE INVENTION

It is therefore an object of the present invention to provide for a new and improved method and means for compressing materials into highly compact packages and which is specifically adaptable for use in compressing hay into highly compressed cubes or pellets.

It is a further object of the present invention to provide an apparatus conformable for compressing crop materials, such as, hay into pellet form at high rates of speed which incorporates novel means for feeding, precompression and positive advancement of the materials in a uniform stream through a pelleting zone.

It is a still further object of the present invention to provide apparatus to effect preliminary sizing and treatment of crop materials for movement in a uniform stream through a precompression zone defined by a continously moving convergent guide path leading into a cubing zone in which the hay is further compressed and simultaneously formed in dense cubes.

It is an additional object of the present invention to provide for apparatus for compressing and pelleting hay and like materials in which the hay can be advanced continuously along a tangential guide path formed between counter-rotating compressor wheels, compressed, cubed and automatically stripped from the wheels in a novel and improved manner.

In accordance with the present invention, a hay presser machine has been devised in which the hay is loaded into a feed bin where it is advanced as a large, slow-moving stream of hay toward a gravity feed inlet. At the gravity feed inlet, the hay is broken up and uniformly distributed onto a relatively fast moving, cross-flow conveyor which diverges away from the inlet in the direction of flow toward a compactor zone which compresses the hay to bale density or higher. The compactor zone is a gradually convergent, continuously moving guide path formed either by endless belt drives, drive wheels or a combination of same, so as to compress the hay into a fast-moving, uniform stream of predetermined size for introduction along a tangential guide path formed between co-planar, counter-rotating press wheels. The press wheels have outer circumferential surfaces defining the guide path which are notched and flanged in such a way as to contain and to further pressurize the hay into individual pellets, as well as to automatically strip the pellets from the notched portions as they rotate away from the guide path. The press wheels are further so constructed and arranged as to be self-compensating with respect to the amount of hay introduced therebetween both with respect to the cross-sectional size of the tangential guide path and the relative speed of movement of the press wheels.

The above and other objects, advantages and features of the present invention will become more readily appreciated and understood from a consideration of the following description of the preferred embodiment when taken together with the accompany drawings thereof, in which:

DESCRIPTION OF THE PREFERRED EMBODIMENT

Figure 4:
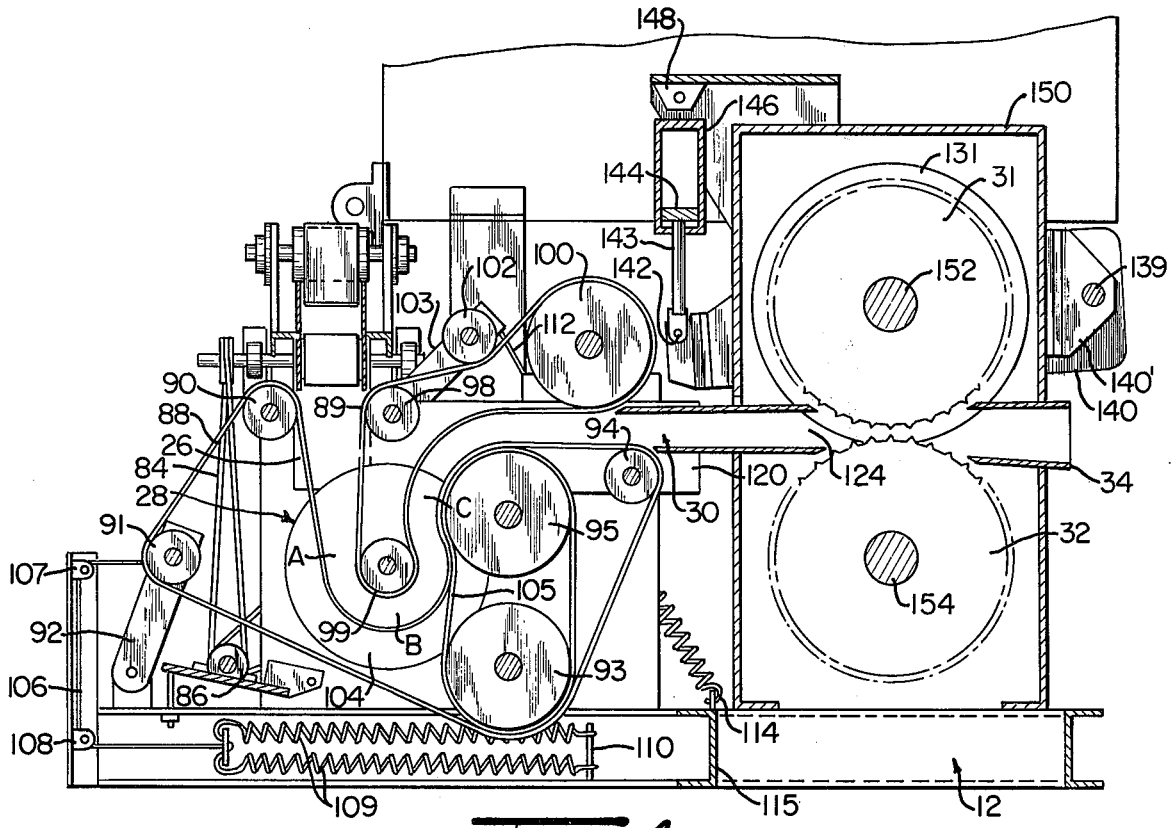
FIG. 4 is a cross-sectional view taken about lines 4—4 of FIG. 3.
Figure 5:
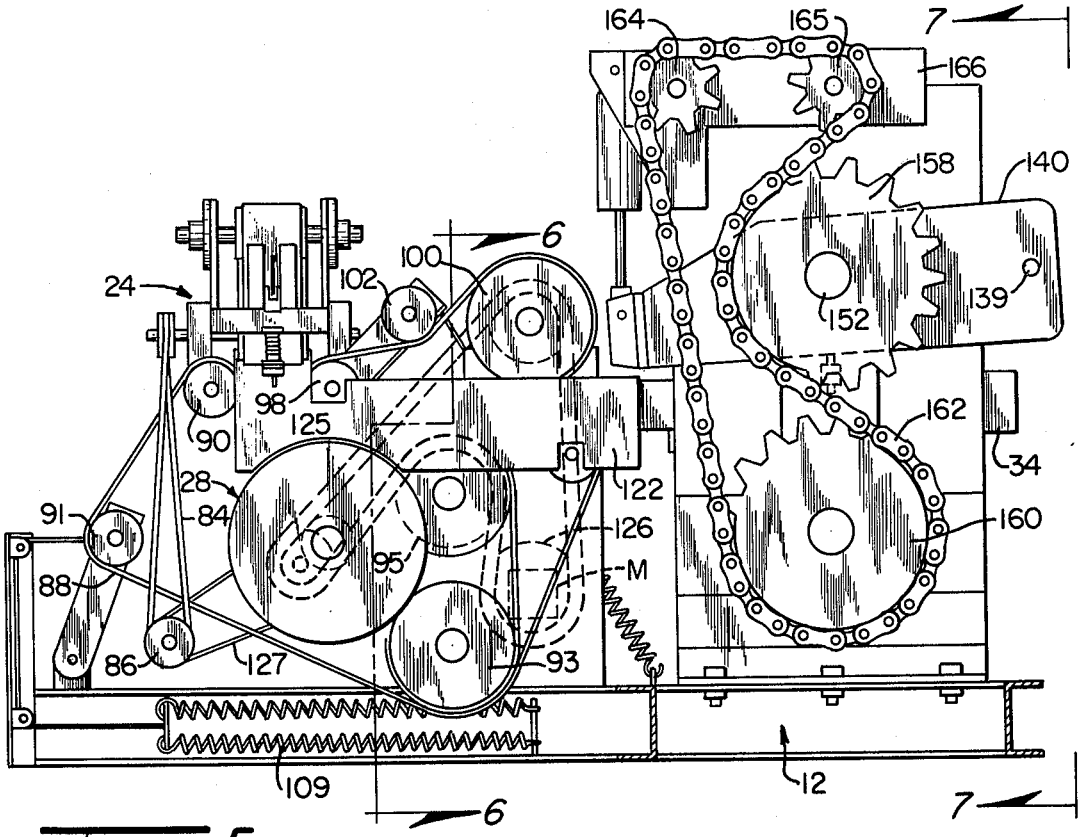
FIG. 5 is a side view of the compacter and press wheel stages in the preferred form of apparatus in accordance with the present invention.
Figure 6:
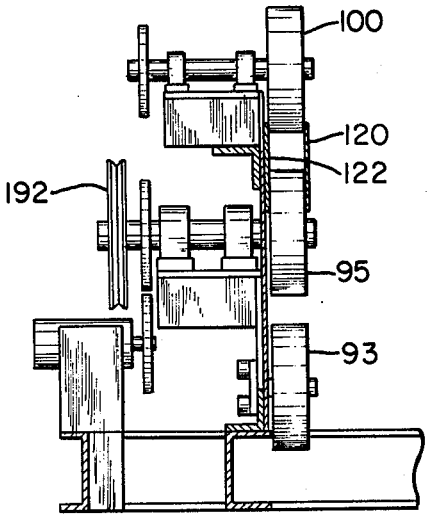
FIG. 6 is a cross-sectional view taken about lines 6—6 of FIG. 5.

Referring in more detail to the drawings, the preferred form of hay presser machine 10 is a portable unit including a chassis or frame 12 mounted on wheels 14 and including a tongue 15 to permit the entire machine to be towed. Hay which has been picked up from the field is loaded in through the top of a feed bin or housing 16 in which is diposed a lifter vane unit 18 and a beater unit 20 adjacent to a gravity feed outlet 22 which advances the hay onto a cross feed conveyor unit 24. The cross feed conveyor 24 serves to advance the hay from the outlet 22 toward the inlet 26 of a compacter or precompression assembly generally designated 28 in FIGS. 3 to 5. At that stage, the hay is essentially compressed to bale density and delivered through the area represented at 30 along a tangential guide path formed between a pair of counter-rotating press wheels 31 and 32 in the pelleting or cubing stage of the machine. Outlet 34 as shown in FIGS. 4 and 5 receives the hay in pellet or cube form to permit its collection in a separate receptacle not shown.

As a preliminary to more detailed consideration of the present invention, it will be appreciated that the mechanized handling of hay for compression and cubing presents a number of considerations and problems unique to the characteristics of hay and other like crop materials. The individual stems of hay as they are picked up from the field are relatively long and tough and are therefore chopped as a preliminary to loading into the upper end of the feed bin 16. In order to advance the hay in a stream which is of substantially uniform cross-section, the handling and treatment of the hay preliminary to the final compression and cubing stage are extremely important not only to assure high-speed production of the pellets or cubes with minimum power requirements, but also to avoid development of unbalanced forces or jamming of the machinery as the hay is advanced therethrough. For this purpose, the feed bin 16 is so constructed and arranged as to assure conversion of the relatively loose, interwined stems of hay into a uniformly fast moving mass or stream of hay when it is deposited onto the cross-feed conveyor 24.

Figure 1:
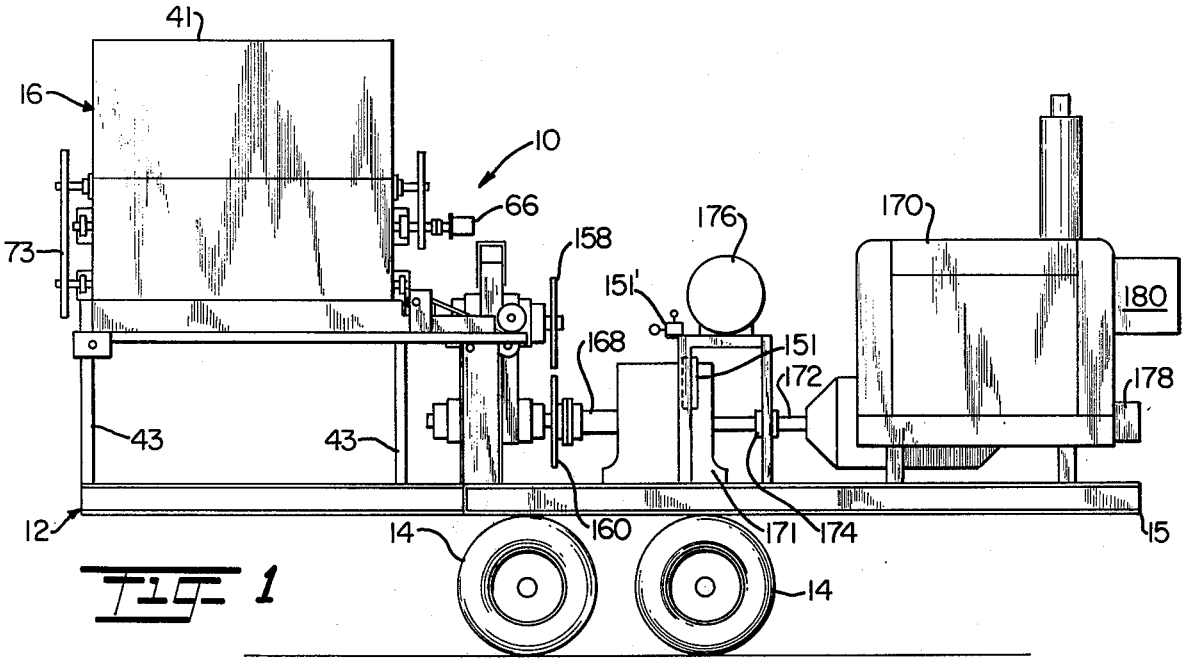
FIG. 1 is a front view in elevation of a preferred form of apparatus in accordance with the present invention.
Figure 2:
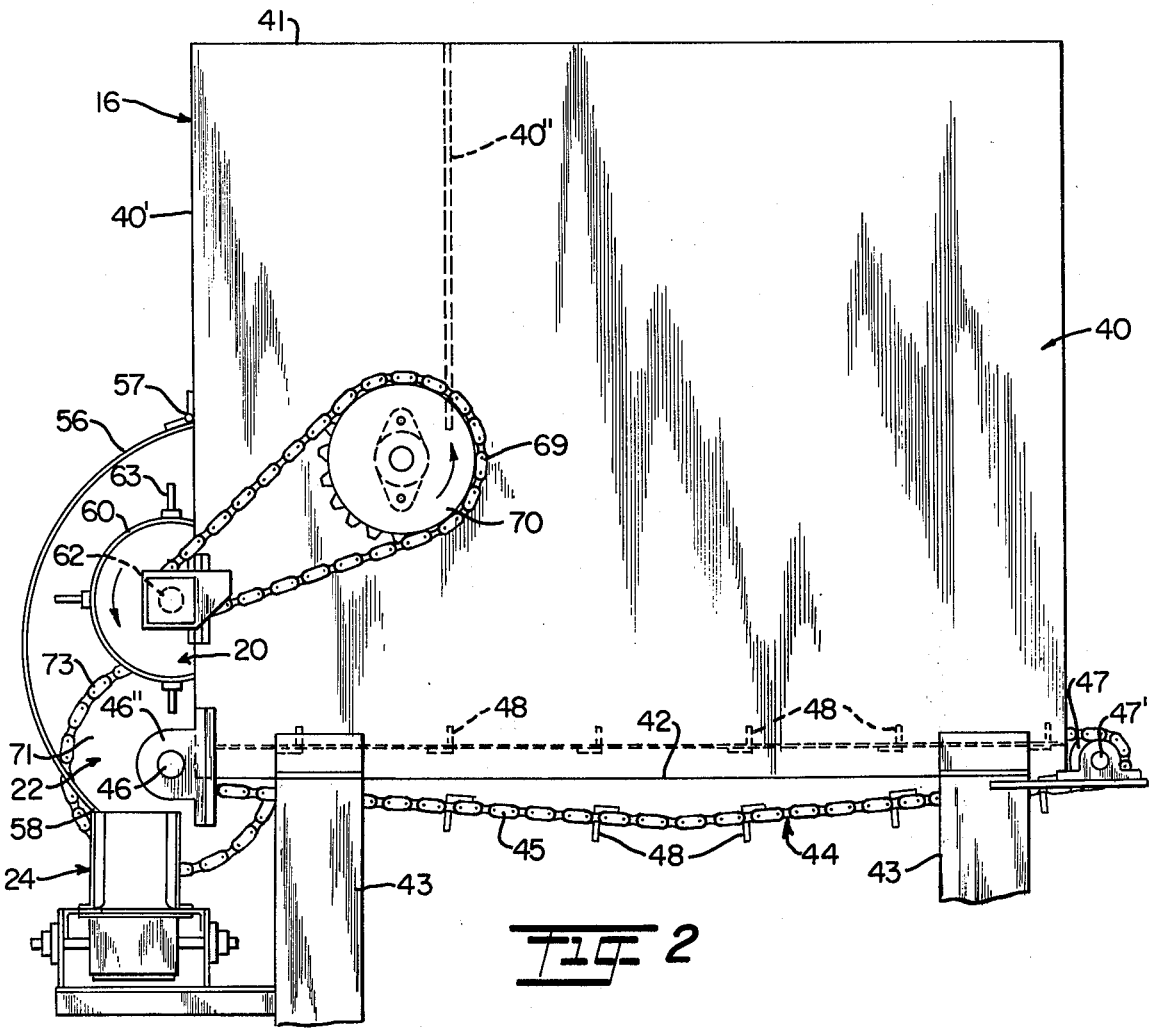
FIG. 2 is a side view enlarged in elevation illustrating the feed bin employed in the preferred embodiment of the present invention.
Figure 3:
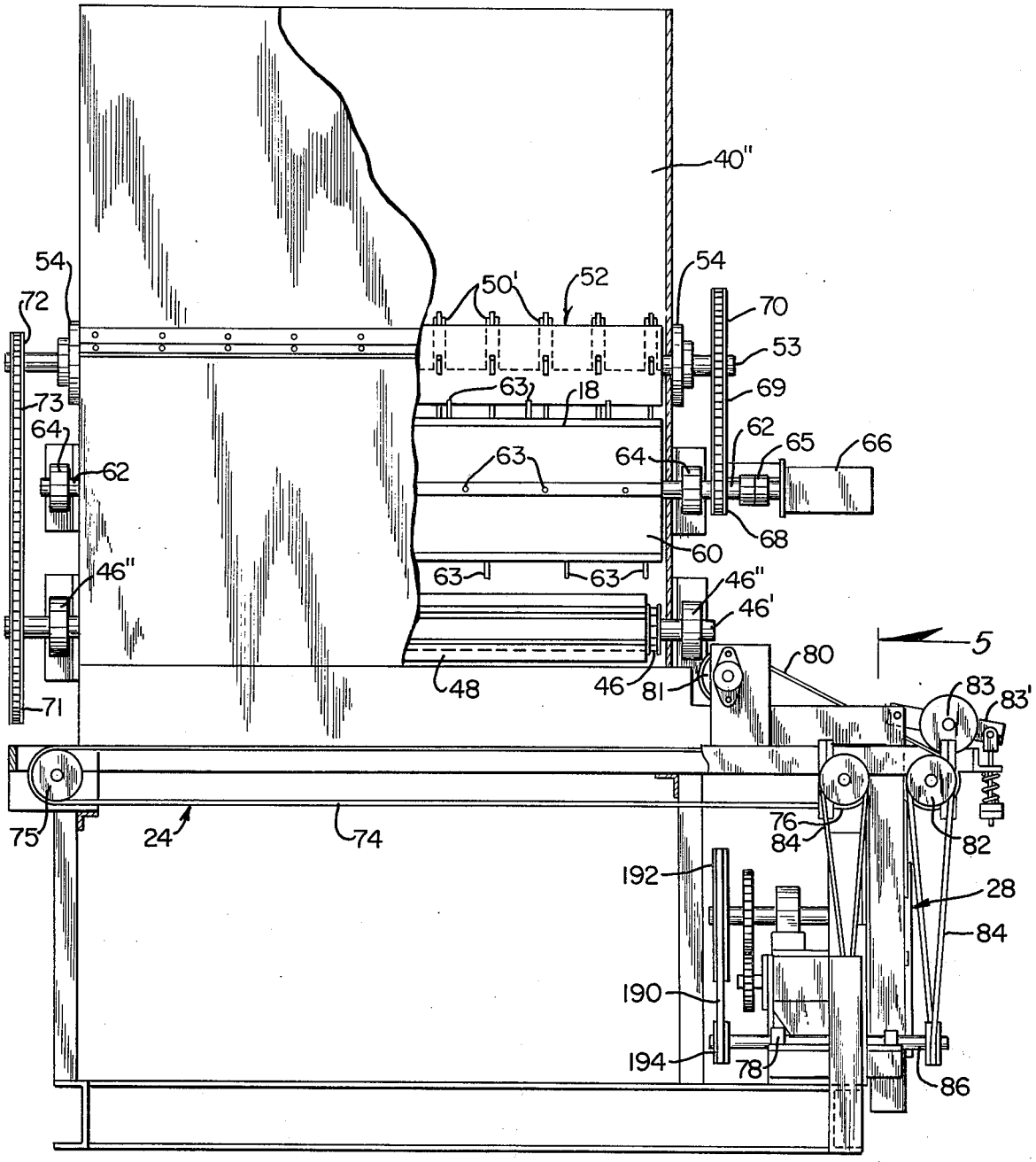
FIG. 3 is a front view partially in section of the feed bin and cross flow conveyor sections of the preferred embodiment of the present invention.

As shown in FIGS. 1 to 3, the feed bin includes a relatively deep rectangular housing 40 having an open top loading end 41 and a closed lower end 42, the housing being supported on vertical posts 43 at each of the four corners of the housing on the rear end of the chassis or trailer 12. Traversing the entire lower closed end 42 of the housing is a conveyor assembly 44 which includes a chain drive made up of a pair of chains 45 each trained over a drive sprocket 46 on a common shaft 46' and an idler sprocket 47 on opposite sides of the feed bin. The chains 45 follow an upper course advancing through slots in the lower end of the housing toward the outlet 22 internally of the housing and a lower course advancing away from the outlet toward each of the idler sprockets 47. Angle irons 48 are mounted at equally spaced intervals along the length of the chains 45 for extension transversely of the direction of advancement of the chains so as to present upwardly extending projections which will engage the hay stacked in the feed bin and tend to advance it toward the gravity feed outlet 22.

The lifter vane unit 18, as best seen from FIGS. 2 and 3, is comprised of a rotor element 52 mounted for rotation on shaft 52, opposite ends of the shaft being journaled in bearings 54, so that the shaft traverses the width of the housing somewhat rearwardly and above the beater unit 20. The lifter cooperates with a scraper wall 40'' in sizing the hay stream advancing toward beater assembly 20. The lifter unit is located just downstream and below scraper wall 50 and is provided with slots 50' at spaced intervals along its lower end adjacent to the lifter 18, so that a series of uniformly spaced radially projecting tines 55 on the unit pass through the slots in the wall. When the lifter is rotated tines 55 lift on the large mass of hay advancing against the lifter separating the portion of the hay stream above the lifter from that below it minimizing any tendency of the hay to become jammed or lodged in advancing through the sizing outlet toward the gravity feeed outlet. Scraper wall 50 directs the hay being lifted by the lifter causing it to recirculate back into the feed bin. The front wall 40' of the feed bin housing 40 includes a hinged, arcuate cover portion 56 which is hinged across the entire front wall section as at 57 directly above the beater assembly 20 and depends downwardly and forwardly over the beater 20 as well as the outlet 22 to terminate in a lower edge 58 extending along the outside edge of the cross feed conveyor 24. The beater assembly 20 includes a hollow cylindrical rotor portion 60 mounted on drive shaft 62, and a series of radially projecting tines 63 project outwardly from the rotor 60 for a distance to traverse the entire length of the gravity feed outlet 22. The beater 20 has its shaft 62 mounted in bearings 64 externally of the lower front wall surface 40' of the housing. One end of the shaft 62 is coupled at 65 to a drive motor 66 in order to impart rotation to the assembly 20. A drive sprocket 68 is keyed to the drive shaft 62 and imparts rotation to shaft 53 for the lifter assembly 52 through chain 69 and driven sprocket 70 on the shaft 53. It will be noted that the speed of rotation of the drive shaft 62 is substantially greater than that of the shaft 53 through the speed reduction afforded through the relatively large driven sprocket 69, and in the preferred form the speed of rotation of the beater 20 is approximately four times that of the lifter 52. Preferably, drive motor 66 is a hydraulic motor with variable speed controls to regulate the speed of rotation of the beater 20 and the lifter unit 18.

The opposite end of the shaft 53 on the lift vane assembly 52 has another sprocket 72 which imparts driving rotation through chain 73 to sprocket 71, the latter being keyed to shaft 46' at the front end of the conveyor assembly 44. The shaft 46' is mounted in bearings 46'' at the lower front corner of the feed bin housing at opposite ends of and directly beneath the gravity feed outlet 22. It will be seen from the relative size of the sprockets 72 and 71 that the drive system undergoes a further reduction in speed between the lift vane assembly 18 and the horizontal conveyor 44, the speed ratio between the lift unit 52 and the horizontal conveyor 44 being approximately three-to-one. In this way, the hay is advanced toward the outlet 22 at a relatively low rate of speed compared to the rotation of the beater 20 and lift rotor 52 in order to minimize jamming as it passes toward the feed outlet 22. As a result, the hay is lifted and dispersed as a small fast moving stream by rotation of beater 20 in the direction shown in FIG. 2 to guide the hay over the beater 20 and onto the conveyor 24.

As further shown in FIGS. 2 to 5, the cross feed conveyor 24 is comprised of an endless flat belt 74 trained for advancement over pulleys 75 and 76 disposed outwardly of and beneath the front corner of the feed bin housing 40, and the upper course of the flat belt 74 is caused to advance in a direction towards the inlet 26 into the compactor unit. Preferably, the lower edge 58 of the cover 56 diverges slightly in a direction toward the inlet 26 so as to avoid build-up in pressure of the hay as it is received from the gravity feed outlet 22 and is advanced toward the inlet 26. Another endless flat belt 80 is trained for advancement over a pair of pulleys 81 and 82 in spaced relation above and outwardly of the pulley 76 so that the lower course of the belt 80 cooperates with the upper drive surface of the belt 74 in forming a guideway for passage of the hay from the horizontal conveyor 24 vertically and downwardly into the inlet 26. Traction between the upper guide belt 80 and pulley 82 is regulated by a roller 83 mounted on a spring-loaded tension arm 83' pivoted at one end to yieldingly engage the upper course of the guide belt 80 forcing it against pulley 82 to regulate the pressure of belt 80 against pulley 82 regardless of the thickness of the stream of hay being fed along the cross feed conveyor.

Preferably, the pulley 76 for the flat belt 74 and the pulley 82 for guide belt 80 are each driven by a quarter turn drive belt unit 84 which is driven off of a common shaft 86 journaled in bearings 78 supported on the chassis or frame 12.

The compactor unit 28 extends rearwardly from the discharge end of the cross-flow conveyor and at right angles thereto along one side of the feed bin housing, as shown in FIGS. 4 and 5. The compactor unit 28 defines a gradually convergent guide path which causes the stream of hay discharged from the cross-feed conveyor to undergo downward movement as indicated at A followed by reverse upward movement indicated at section B then to curve into a horizontal guide path indicated at section C leading into the discharge passage 30. The gradually convergent, reverse-curved guide path at sections A, B, and C is defined by a unique combination of flat belts 88 and 89 driven over a series of rollers to be described so as to sandwich the hay between the moving flat belts as it is forced to pass through the gradually convergent path formed. It will be noted that the outer belt 88 along the guide path is an endless belt which is trained for rotation over a drive roller 90 mounted for rotation on a fixed axis, compression roller 91 mounted for rotation on swing arm 92, a larger diameter roller 93 mounted for rotation on a fixed axis, another smaller roll 94 also mounted for rotation on a fixed axis, and a relatively large roller 95 mounted for rotation on a fixed axis. In turn, the inner belt 89 is also an endless flat belt mounted for advancement over rollers 98 and 99 each rotatable on a fixed axis, a relatively large roller 100 rotatable about a fixed axis and a compression roll 102 mounted on swing arm 103 to regulate the tension of the drive belt 89. The central roller 99 is provided with side flanges 104 which are dimensioned to flank opposite side edges of the belt through the major compression part of the guide path.

In order to assist in maintaining a gradually convergent path and avoiding a sudden reduction in thickness between rollers 95 and 99, an endless flat belt 105 is trained for advancement over the rolls 93 and 95 so as to be interposed between the belt 88 and the upper roll 95 and to exert some external pressure against the belt 88 in its upward movement over the roller 95. Additional compressive force is applied to the belt 88 by the compression roll 91 which is urged outwardly against the inner surface of the belt by cable member 106 which passes downwardly over pulley guides 107 and 108 and is affixed to the free ends of a pair of compression springs 109. Opposite ends of the compression springs are anchored by a post 110 to exert a force on the cable member 106 tending to urge the roller 91 outwardly and to increase the tension on the endless belt 88.

Similarly, an inwardly directed force is applied to the upper flat belt 89 by the roller 102 which is urged inwardly against the external surface of the belt by a cable 112 attached to compression spring 114, the latter anchored to flange 115 on the chassis 12.

As the hay is advanced from the cross-feed conveyor into the convergent guide path formed by the belts 88 and 89, the belts cooperate with the side flanges 104 on the roller 99 to positively advance the hay along the convergent guide path, which preferably converges on the order of 15°, while minimizing any slippage of the hay with respect to the side flanges 104 or belts 88 and 89 as it is being compressed. Some compression is applied to the hay by the tension of the outside belt passing around the roller 99 under the yieldable urging of the roller 91, and final compression is exerted between the rollers 95 and 99 where the belts 88 and 89 pass therebetween then angle horizontally toward the outlet end 30. The compactor unit as described is not only effective to cause precompression of the hay to a level approximating bale density, but also maintains a uniform, compact stream of hay which can be fed into the press wheel zone. Most desirably, guide walls 120 and 122 flank opposite sides of the flat belts 88 and 89 along that section of the guide path leading away from the flanges 104 toward the discharge end 30 to aid in guiding the stream of hay into the horizontal entrance duct 124 which extends in a tangential direction between the counter-rotating press wheels 31 and 32. Preferably the duct 124 is generally rectangular in cross-section and diverges slightly in cross-sectional size away from the section end 30 towards the discharge end 34. The belts 88 and 89 are driven through the chain drive assembly 125, as represented in FIG. 5, which is trained over sprockets on the rollers 95, 99 and 100 as well as a drive sprocket 126 at the end of a hydraulic motor drive represented at M. In addition, the roller 95 has a drive pulley for a belt drive 127 into the lower drive pulley on the cross feed conveyor drive shaft 86.

Figure 8:
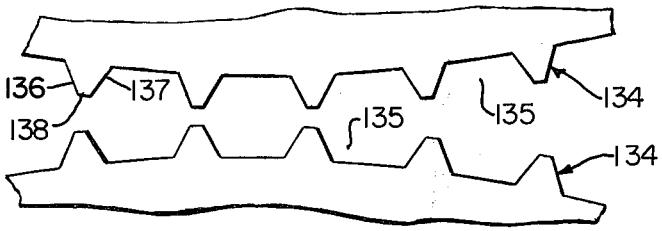
FIGS. 8, 9 and 10 are enlarged fragmentary views in detail showing the intermeshing engagement between the teeth on the counter-rotating press wheel in accordance with the present invention.
Figure 9:
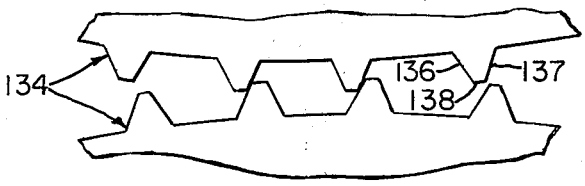
Figure 10:
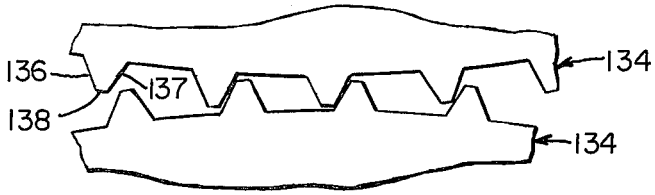
Figure 7:
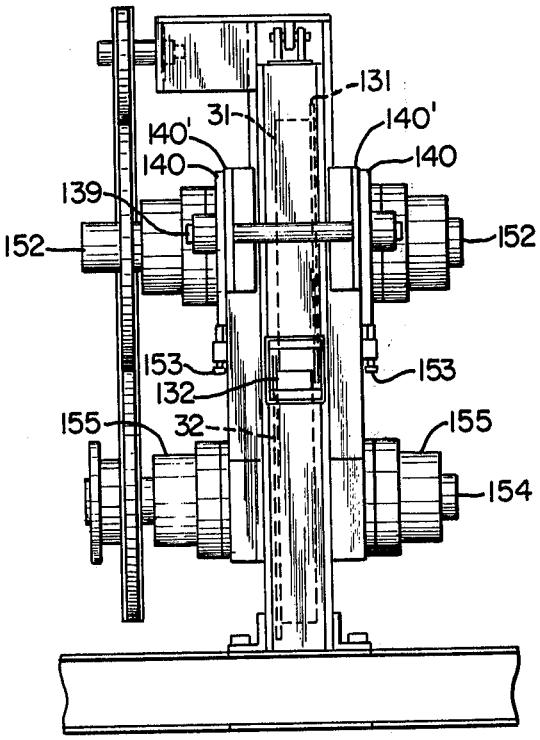
FIG. 7 is an end view taken from lines 7—7 of FIG. 5.

As shown in FIGS. 4, 5 and 7, the upper and lower press wheels 31 and 32 are arranged in coplanar, counter-rotating relation to one another, the upper press wheel 31 having a side flange 131 which overlaps one side of the outer circumferential surface of the lower press wheel 32; and in turn the lower press wheel 32 includes a side flange 132 on a side opposite to that of the flange 131 which overlaps the side of the outer circumferential surface of the upper press wheel 31. Each of the upper and lower press wheels 31 and 32 is provided with correspondingly formed teeth 134 which, as best seen from FIGS. 8 to 10, are separated by notches 135 at equally spaced circumferential intervals along the circumferential surface of each of the press wheels, and each tooth traverses the entire width of the outer circumferential surface of its respective wheel. Each tooth is tapered outwardly symmetrically about a radial line in the center of its press wheel to present opposite flat tapered or inclined surfaces 136 and 137 terminating in an outer tip or squared end portion 138.

In order to maintain a predetermined pressure on the hay passing along the tangential guide path and to be able to compress the hay to a selected density independently of its feed rate or cross-sectional size of the stream of hay, the upper press wheel 31 is pivotally suspended on a shaft 152 extending between opposite sides of a bifurcated mounted arm 140 and affixed to main housing 150 by brackets 140'. The mounting arm 140 is pivotal under the control of a pivot link attachment 142 through the lower end of rod 143 which has its piston 144 reciprocal in a hydraulic cylinder 146. The cylinder 146 depends downwardly from a mounting bracket 148 above press wheel housing 150 and its pressure is regulated through an accumulator 151 and hand pump 151' which forms a part of the hydraulic control system of the apparatus to normally urge the mounting arm 140 downwardly about the shaft 139 toward the lower end stops 153 shown in FIG. 7. The upper press wheel 31 is mounted for rotation on the shaft 152 which is mounted in pillow blocks at an intermediate portion of the mounting arm 140. In turn, the lower press wheel 32 is mounted for rotation on shaft 154 which extends through pillow blocks 155.

As best seen from FIG. 5, sprockets 158 and 160 are keyed to the upper and lower stub shafts 152 and 154, respectively, and a single chain 162 is wrapped around the sprockets 158 and 160 in reverse directions to effect counter-rotation of the press wheels. The upper course of the chain is trained for advancement around upper idler sprockets 164 and 165 which are journaled to an upper frame member 166 mounted on the press wheel housing 150. Driving rotation is imparted to the press wheels through the main drive shaft 168 from the central control system to be described and which is operatively coupled to the lower drive sprocket 160. Under the force of hydraulic pressure applied to the cylinder 146, the press wheels 31 and 32 will compensate for variations in the feeding rate of hay by permitting the upper press wheel 31 to move toward or away from the lower press wheel depending upon the volume rate and pressure of hay fed between them. For instance, the press wheels are capable of advancing the teeth between the positions illustrated in FIG. 8 in which the teeth are separated to the intermeshing relationship as shown in FIGS. 9 and 10. Thus, as less hay is fed between the counter-rotating press wheel the upper wheel will be movable downwardly under the urging of the cylinder 146 to cause its teeth to enter into the notches formed between the teeth and the lower press wheel, as shown in FIG. 9; or advanced to a position in which the outer ends of the teeth on the upper press wheel are at the bottom of the notches in the lower wheel as illustrated in FIG. 10 and the mounting arm 140 is resting on the stops 153. As the wheels advance closer together, the drive chain would tend to become slack without relative rotation of the wheels; however, since the upper wheel 31 is driven by the chain, it will rotate less in order to allow the teeth to slide past one another. In this relation, the sprockets are sized to permit relative rotation between the wheels according to the shape of the teeth. In this manner, the stream of hay fed along the tangential guide path between the teeth will be simultaneously compressed and divided into cubes or pellets by the teeth. The rotating side flanges 131 and 132 serve the important function not only of containing the stream of hay along the tangential guide path but of automatically stripping the pellets from the notches as the teeth rotate away from one another on the discharge sides of the press wheels leading into the discharge section 34. Specifically, the side flanges 131 and 132 in rotating away from one another on the discharge side of the guide path will exert an outwardly directed force on the pellets formed in the notches on the opposite press wheel.

In order to drive the press wheel unit independently of the compactor 28, a diesel engine 170 defines a motive power source at the front of the chassis 12 having a drive shaft 172 through a chain coupler 174 to speed reducer 171 with output drive shaft 168. A fuel tank is represented at 176 for the diesel engine. For the purpose of operating the compactor unit motor M and the drive motor 66 for the feed bin conveyor and rotor units, a hydraulic pump 178 is located at the front of the diesel engine together with a reservoir 180. The motors M and 66 are connected in series to the pumps 178 and, although not shown, fluid under pressure is applied to each of the drive motors M and 66 from the pump 178 through a conventional flow control valve, not shown. In this way, the feed bin conveyor sections, compactor unit and press wheel can be independently operated but in close correlation to one another so as to closely regulate the speed of travel of the hay. The cross feed conveyor drive pulleys 76 and 82 as described may be suitably driven by the belt drives 84 off of a drive belt 190 extending from a belt drive pulley 192 on the upper drive roll 95 in the compactor unit. The drive belt 190 is trained over a pulley 194 on the common shaft 86 for the drive units 84.

From the foregoing, it will be appreciated that a novel and improved form of hay pressing machine have been devised for continuously pressing the hay into extremely dense cubes. As the chopped hay leaves the feed bin 16 it may be moisturized in a well-known manner preliminary to advancement over beater unit 20 into the outlet 22. As previously described the stems of hay will be uniformly dispersed onto the cross feed conveyor 24 by the cooperative action of the conveyor 44, lift 18 and beater 20 in preparation for its travel along the conveyor 24 into the inlet 26 of the comparator 28.

The hay is contained for movement along the sections A, B and C of the compactor by the belt members 88 and 89 together with the side flanges 104 which form a convergent path of travel for the hay into the press wheel zone. The degree of compression in the compactor is such that hay can be fed uniformly in a compact mass between the press wheels where it is further compressed and divided by the teeth 134 into cubes corresponding in configuration to the notched area formed between confronting teeth on the press wheels. Since the side flanges 131 and 132 are positioned on opposite sides of the wheels 31 and 32 and move away from one another on the discharge side of the guide path formed between the wheels, they will dislodge and strip the hay cubes from the notched areas 135 whereupon the cubes will be discharged through outlet 34 for collection in a separate receptacle.

Figure 11:
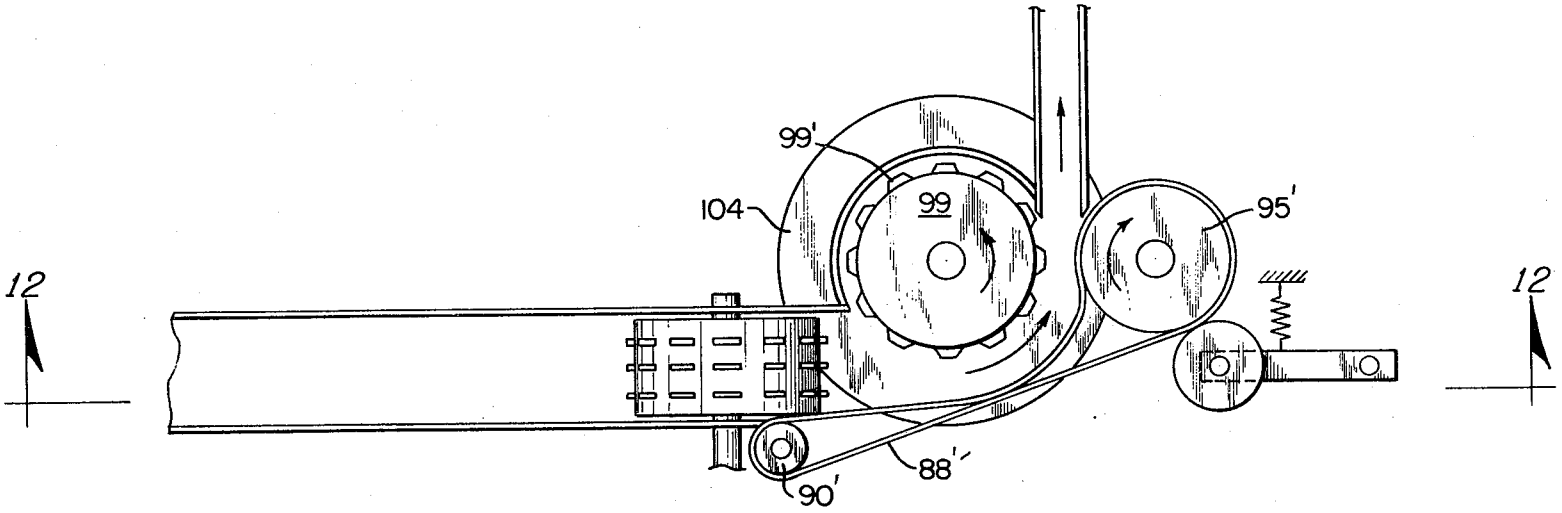
FIG. 11 is a plan view of a modified form of compactor unit.
Figure 12:
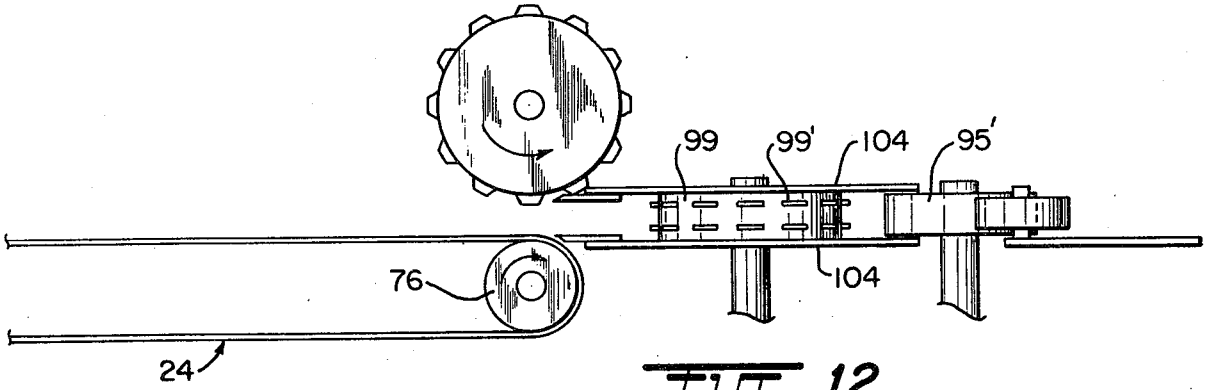
FIG. 12 is a sectional view taken about lines 12—12 of FIG. 11.

A modified form of compactor unit is illustrated in FIGS. 11 and 12 in which the belt 89 is replaced by teeth 99' on the outer circumferential surface of roller 99 as one of the moving surfaces to greatly enhance its hay gripping capability. Also shown, the compactor lies in a horizontal rather than a vertical plane, and the entire unit is shifted to a position placing the roller surface directly adjacent to the discharge end of the conveyor 24. Since the stream of hay doesn't change direction to enter the compactor, a wheel 190 may be used to replace guide belt 80 on the conveyor. A spring loaded wheel 90' provides traction pressure between the roller 95' and belt 88' to cause the belt to turn during start-up when there is insufficient hay in the compactor to tension the belt.

Although the present invention has been described with a certain degree of particularity, it is understood that the present disclosure has been made by way of example and that changes in details of structure may be made without departing from the spirit thereof.

What is claimed is:

1. In a machine for compressing hay and the like into dense, generally pellet-like units, a pair of coplanar wheels mounted for rotation on parallel axes, said wheels provided with circumferential surfaces defining a common tangential guide path for advancement and compression of hay therebetween, pellet forming means defined by radially projecting, circumferentially spaced teeth and pellet-forming notches therebetween on the circumferential surface of said wheels adapted to cooperate in advancing the hay along the guide path, means to cause displacement of the rotational axis on one wheel with respect to the other to regulate the spacing between the teeth on said wheels along the guide path in accordance with the amount of hay passing along the tangential guide path whereby the teeth on the one wheel are displaceable between an overlapping and non-overlapping relation to the teeth on the other wheel along the tangential guide path, each wheel having hay-confining means on one side opposite to the hay-confining means on the other wheel, said hay-confining means on the opposite side of each wheel overlapping the circumferential surface on the other wheel along the tangential guide path to constrain the passage of hay therebetween, said hay-confining means moving substantially in the same direction as the hay while closing opposite sides of the pellet-forming notches along the guide path, said hay-confining means further diverging away from one another on the discharge side of the guide path so as to move away from the sides of the pellet-forming notches on the circumferential surfaces in a direction to encourage withdrawal of the pellets from the notches as the circumferential surfaces move away from one another on the discharge side of the guide path.

2. In a machine according to claim 1, said hay-confining means being defined by a radially extending side flange on the opposite side of each of said wheels dimensioned to overlap the circumferential surface of the other wheel along the tangential guide path, the ends of each pellet being withdrawn from one side of each wheel by the side flange of the other wheel as the wheel surfaces rotate away from the tangential guide path.

3. In a machine according to claim 1, each wheel having an outer circumferential surface defining a common tangential guide path therebetween, and drive means for rotating said wheels in counter-rotation to one another.

4. In a machine for compressing hay and the like into dense, generally pellet-like units, a pair of counter-rotating, co-planar wheels mounted for rotation on parallel axes, each of said wheels provided with a circumferential surface defining a common tangential guide path for advancement and compression of hay therebetween, pellet-forming means defined by radially projecting, circumferentially spaced teeth on the circumferential surface of each wheel adapted to intermesh along the tangential guide path defined between said wheels and adapted to cooperate in advancing the hay along the guide path, hay-confining means on opposite sides of the circumferential surfaces of said wheels along the tangential guide path to constrain the passage of hay therebetween, means to cause displacement of the rotational axis of one wheel with respect to the other to regulate the spacing between the teeth on said wheels along the guide path in accordance with the amount of hay passing along the tangential guide path whereby the teeth on the one wheel are displaceable between an overlapping and nonoverlapping relation to the teeth on the other wheel along the tangential guide path, one of said wheels being movable toward and away from the other wheel to vary the distance between opposing circumferential surfaces along the guide path, and said drive means being operative to vary the rate of rotation of the one wheel with respect to the other in correlation with its movement toward and away from said other wheel.

5. In apparatus for pelletizing hay and the like, a compactor unit comprising opposed movable facing surface means movable along a convergent guide path, means for driving said facing surfaces continuously in the same direction along the convergent guide path means including rotatable side flange means substantially covering opposite sides of the convergent guide path, said movable facing surface means cooperating with said side flange means in containing and advancing the hay along the convergent guide path while simultaneously densifying the hay material, coplanar press wheels at the outlet end of said compactor means, said press wheels presenting opposed circumferential surfaces defining a tangential guide path therebetween for continuous advancement and compression of the material from the outlet of said compactor means, side flange members alternately disposed on opposite sides of each press wheel to overlap the opposed circumferential surfaces and defining hay-confining means on opposite sides of the guide path, and pellet forming means defined by radially projecting, circumferentially spaced teeth and pellet-forming notches therebetween on the circumferential surface of said press wheels adapted to cooperate with said side flange members in advancing the hay along the guide path.

6. In apparatus for pelletizing hay according to claim 5, at least one of said movable facing surface means along the convergent guide path comprising a flexible drive belt means.

7. In apparatus according to claim 6 one of said movable facing surface means comprising an outer circumfirential roller surface, said side flange means rotatable with said roller.

8. In apparatus according to claim 5 said roller surface having projections to positively advance the hay material along the convergent guide path.

9. In apparatus for pelletizing hay and the like, a compactor unit comprising flexible drive belt means defining opposed facing surfaces movable along a convergent guide path, belt drive wheel means for driving said flexible belt drive means continuously in the same direction along the convergent guide path, said drive wheel means cooperating with said side flanges to contain and advance the hay material along the convergent guide path while simultaneously densifying the hay, and coplanar press wheels at the outlet end of said compactor means, said press wheels presenting opposed circumferential surfaces defining a tangential guide path therebetween for continuous advancement and compression of the material from the outlet of said compactor means, said press wheels including hay-confining means in the form of radially extending side walls on opposite sides of the tangential guide path, and pelletizing means projecting from the circumferential surfaces of said press wheels into the tangential guide path to divide the crop material into pellet-like form.

10. In apparatus for pelletizing hay according to claim 9, said drive belt means undergoing a reversal in direction of substantially 180°.

11. In apparatus for pelletizing hay according to claim 9, said compactor unit including a substantially horizontal inlet communicating with the convergent guide path, the convergent guide path extending downwardly substantially at 90° to the inlet then reversing itself upwardly at substantially 180° to the downwardly extending course.

12. In apparatus for pelletizing hay according to claim 11, said upwardly extending course continuing into a horizontal outlet.

13. In apparatus for pelletizing hay according to claim 9, said drive wheel means including means yieldably urging said drive belt means toward one another to form a gradually convergent guide path in which the angle of convergence of said drive belt means is on the order of 15°.

14. A pelletizing machine for crop materials comprising:

feed means including a gravity feed outlet for the crop material, a cross flow conveyor section located beneath said gravity feed outlet for transfer of the crop material in a direction transversely of its movement through said gravity feed inlet, means to disperse the crop material as it is advanced through said gravity feed outlet, compactor means communicating at an inlet end with said cross flow conveyor means, said compactor means advancing the crop material along a convergent guide path defined and substantially contained by continuously moving surfaces, and co-planar press wheels at the outlet end of said compactor means, said press wheels presenting opposed circumferential surfaces defining a tangential guide path therebetween for continuous advancement and compression of the material from the outlet of said compactor means, said press wheels including radially extending side walls on opposite sides of the tangential guide path and pelletizing means projecting from the circumferential surfaces of said press wheels into the tangential guide path to divide the crop material into pellet-like form.

15. A pelletizing machine according to claim 14, said feed means including a horizontal conveyor for advancing the materials toward the gravity feed outlet, said dispensing means means defined by a lift rotor and a beater rotor in spaced relation above said horizontal conveyor adjacent to said gravity feed outlet.

16. A pelletizing machine according to claim 14, said feed means including a housing, said gravity feed outlet located along a lower horizontal edge of said housing, and a hinged panel on said housing extending outwardly from above said gravity feed outlet over said cross feed conveyor.

17. A pelletizing machine according to claim 14, said compactor means causing the materials to undergo at least one change in direction while densifying the materials preliminary to advancement along the tangential guide path between said press wheels.

* * * * *

UNITED STATES PATENT OFFICE

CERTIFICATE OF CORRECTION

Patent No. 3,973,484 Dated 10 August 1976

Inventor(s) Ronald T. Jarrett & Edward J. Barrett

It is certified that error appears in the above-identified patent and that said Letters Patent are hereby corrected as shown below:

Column 3, line 10, cancel "diposed" and substitute --disposed--.

Column 4, line 1, cancel "52" and substitute --53--.

Column 7, line 12, cancel "mounted" and substitute --mounting--.

Column 8, lines 46 and 47, cancel "comparator" and substitute --compactor--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*